United States Patent [19]

Perkins

[11] 4,342,244

[45] Aug. 3, 1982

[54] MUSICAL APPARATUS

[76] Inventor: William R. Perkins, 3872 Cody Rd., Sherman Oaks, Calif. 91403

[21] Appl. No.: 117,117

[22] Filed: Jan. 31, 1980

Related U.S. Application Data

[63] Continuation of Ser. No. 853,255, Nov. 21, 1977, abandoned.

[51] Int. Cl.[3] ..... G10H 1/00

[52] U.S. Cl. ..... 84/1.01; 84/1.04; 84/171

[58] Field of Search ..... 84/1.01, 1.04, 1.1, 84/171, DIG. 7

[56] References Cited

U.S. PATENT DOCUMENTS 3,767,834 10/1973 Hebeisen et al. ..... 84/1.24

3,938,419 2/1976 DeRosa ..... 84/1.14

*Primary Examiner*—J. V. Truhe

*Assistant Examiner*—Forester W. Isen

*Attorney, Agent, or Firm*—Francis X. LoJacono

[57] ABSTRACT

A musical apparatus including a novel combination by which a musician may control the output of a musical synthesizer, while playing his own musical instrument in a normal manner. The musical synthesizer may be pre-programmed for many unusual and exciting tonal effects—such as harmonics, dissonances, parallel tracking, electronic sounds, etc. Broadly speaking, the present invention associates individual tone switches with respective tone control elements of the musical instrument. When the instrument is played, its tone-control elements function to "set" the associated tone switches to an active setting that completes associated tone circuits, so that corresponding electric tone signals are produced for application to the musical synthesizer.

2 Claims, 5 Drawing Figures

FIG. 1.
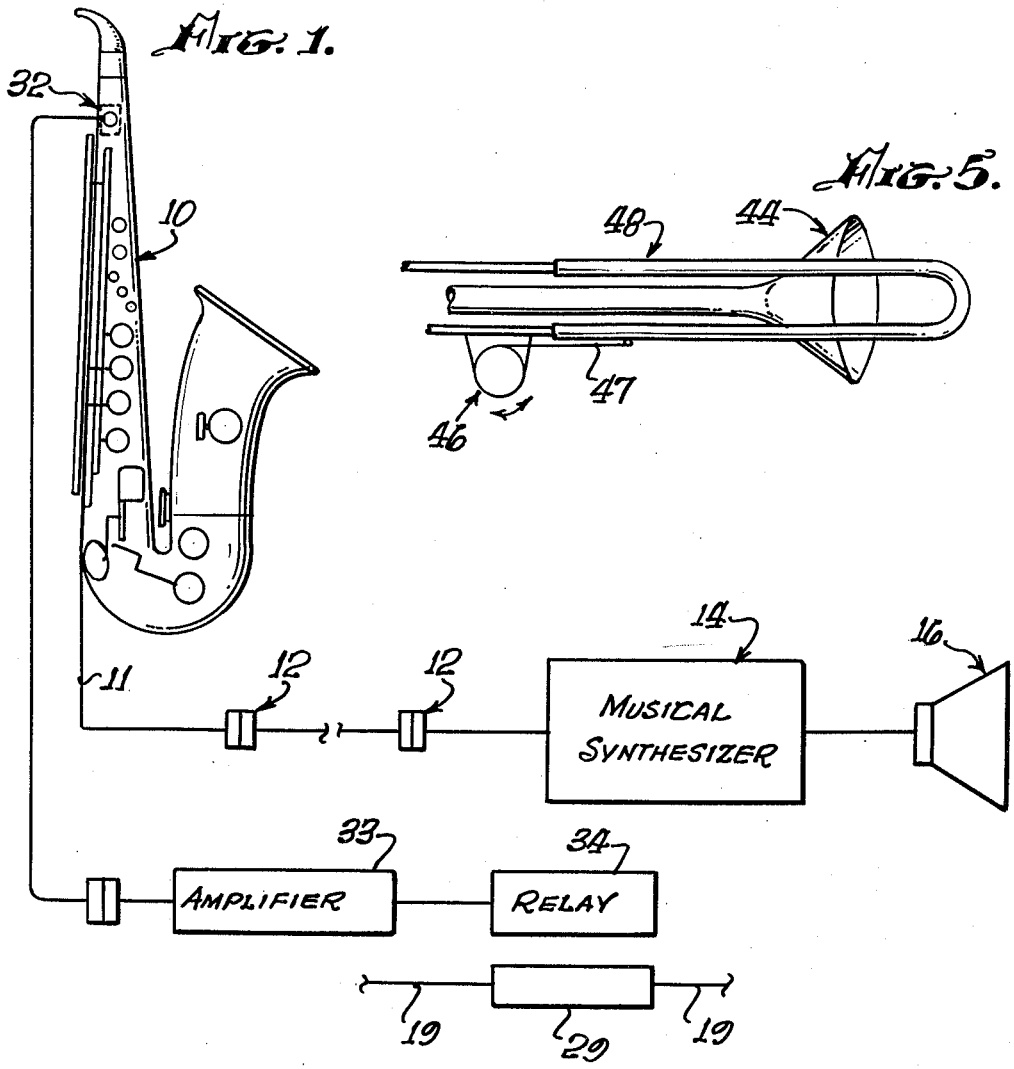
FIG. 5.
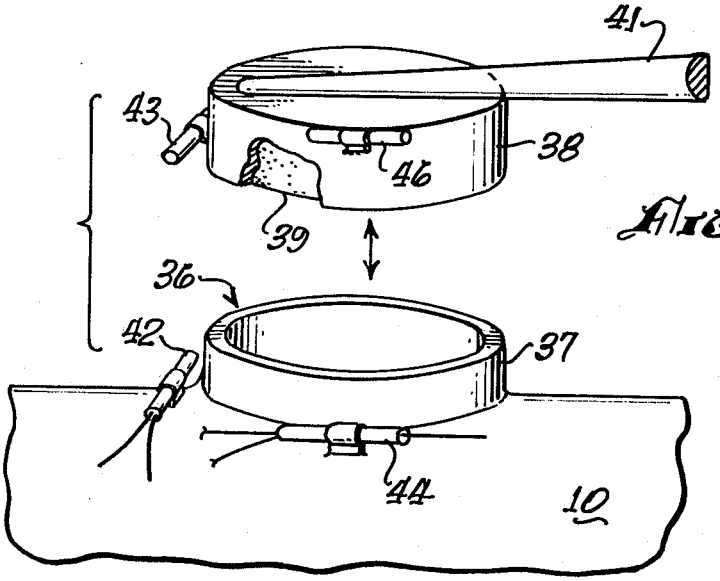
FIG. 4.

MUSICAL APPARATUS

This is a continuation of application Ser. No. 853,255 filed Nov. 21, 1977, now abandoned.

BACKGROUND OF THE INVENTION

1. Field of the Invention

The present invention relates to musical apparatus and, more particularly, relates to a novel combination by which a musician may control the output of a musical synthesizer, while playing his own musical instrument in a normal manner.

2. Description of the Prior Art

It is well known that musicians and composers are constantly seeking ways to make more interesting sounds.

Recently, the composers have acquired new electronic apparatus known as a "synthesizer", this being capable of producing (synthesizing) an enormous variety of electric waveforms that may be applied to loudspeakers—thereby producing an extremely wide spectrum of "electronic" sounds, some of which approximate known sounds, and others of which are entirely new. The basics of these synthesizers are discussed in the book entitled "The New World of Electronic Music" by Walter Sear, the author making such statements as " . . . makes it possible to generate tens of thousands of entirely new sounds" (page 69); "It is like inventing a new instrument every time that the synthesizer is programmed." (page 71); "The synthesizer can also generate many sounds which cannot be produced by the human voice, nor by any other instrument." (page 72).

Many musical composers are enthralled by this new synthesizer; and new musical compositions are appearing in ever-increasing numbers.

Unfortunately for the musical instrumentalist, however, no new musical instruments have been introduced in a relatively long time; so that instrumentalists have generally been limited to improving their playing techniques. While it is true that electronic systems have been developed for some instruments—such as the guitar, the drum, the accordian, etc.—these electronic systems have generally comprised selective amplifiers that merely changed the balance of the musical tones and/or provided limited special effects.

It is, therefore, still desirable to introduce new ways by which an instrumentalist can produce new and exciting sounds.

SUMMARY OF THE INVENTION

It is well known that musical tones are produced by vibrations—the "string" instruments causing strings to vibrate in special ways, the "percussion" instruments causing selected materials to vibrate in special ways, and other instruments causing a column of air to vibrate in special ways.

This latter group of vibrating-air-column instruments includes such diverse instruments as the pipe organ, horns, brasses, wind instruments, reed instruments, lip-controlled instruments, etc. Some of these vibrating-air-column instruments produce different tones by permitting the instrumentalist to change the length of the vibrating-air-column—one sub-group changing the length of the air column by physically inserting or removing selected lengths of tubing, whereas another sub-group changing the length of the air column by permitting the instrumentalist to cover or uncover (finger) selected tone holes having predetermined sizes and locations.

For clarity of disclosure, the subject invention will be presented in terms of a saxophone—which is a member of the fingered sub-group, although the invention should not be construed as being limited to use with a saxophone—as will be discussed later.

The saxophone is a vibrating-air-column instrument wherein the vibrating-air column extends substantially from the mouthpiece to the first open tone hole. When a selected key of the saxophone is fingered, a mechanically complex "keyworks" causes that key's associated "pad" to open or to close an associated tone hole—in this way, controlling the length of the vibrating-air column, and thus controlling the emitted acoustic tone. For the purpose of this presentation, each tone hole may be considered to have a corresponding acoustic tone associated with it, although this is not precisely true, as will be discussed later. Thus, "fingering" the various saxophone keys—i.e., covering and uncovering their associated tone holes—causes the saxophone to produce a series of musical tones. These various tones, as controlled by the tone-control keys, may be modified by the instrumentalist—according to his ability and to the capabilities of the particular instrument; but, in general, each instrumentalist desires to produce still other musical sounds—which are presently beyond his scope.

It should be noted that the disclosed invention is not a prior-art, selective amplifier; rather, it is a novel combination that permits an instrumentalist to play his musical instrument in a normal manner, and to simultaneously activate an electrophone to produce electronic sounds that form a new and exciting musical combination with the acoustic tones emitted by his acoustic musical instrument.

OBJECTIVES OF THE INVENTION

It is the principal objective of the present invention to provide an improved musical apparatus.

It is another objective of the present invention to provide an improved musical apparatus that comprises a novel combination of a musical instrument and a synthesizer.

It is still another objective of the present invention to provide an improved musical apparatus that permits a synthesizer to be controlled by a musical instrument.

It is a further objective of the present invention to provide an improved musical apparatus that permits a synthesizer to be controlled by an instrumentalist playing his musical instrument in the normal manner.

It is a still further objective of the present invention to provide an improved musical apparatus that is a novel combination of a musical synthesizer and a saxophone.

It is a still further objective of the present invention to provide an improved musical apparatus that comprises a novel combination of a musical synthesizer and a trombone.

It is a still further objective of the present invention to provide an improved musical apparatus that permits a musical synthesizer to provide tonal effects that correspond to the acoustic tones of a musical instrument.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 shows a block-and-schematic representation of the overall musical apparatus;

FIG. 4 shows a typical arrangement of a tone switch; and

FIG. 5 shows a typical arrangement for incorporating a trombone.

DESCRIPTION OF THE PREFERRED EMBODIMENT

Figure 2:
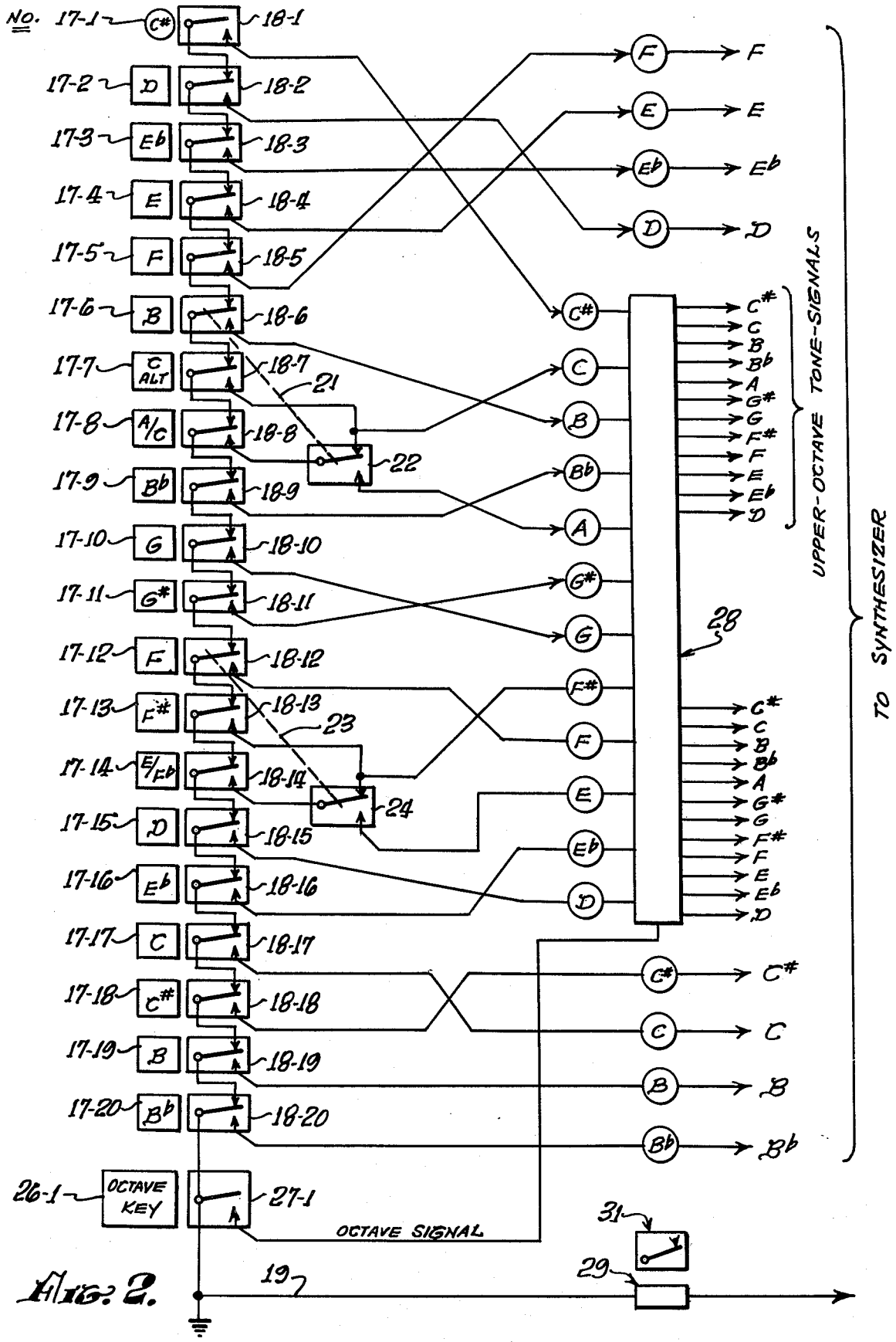
FIG. 2 shows a schematic wiring diagram of circuitry for producing normal tone signals.

As indicated above, the saxophone has a basic fingering pattern whereby a key is associated with a given acoustic tone; so that there is an essentially one-to-one relationship between each key and an associated tone.

In accordance with the present invention, a plurality of "tone switches" (to be shown and discussed later) is mounted on the saxophone 10 of FIG. 1; so that each of the saxophone keys is associated with a respective tone switch. These tone switches are capable of completing or breaking an associated respective "tone circuit"; and the electric "tone wires" of the various tone circuits are gathered into a "tone cable" 11 of FIG. 1. Cable 11 may, if desired, be separatable by means of a suitable electric connector 12 that may alternatively be affixed to the saxophone 10.

The various tone wires of the tone cable 11 are directed—through another suitable electric connector 12, if so desired—to a synthesizer 14; and the output of the synthesizer is applied to a loudspeaker system 16. Practically any synthesizer may be used, these ranging from the more-complex Moog units to the relatively simple Stylophone manufactured by Stylophone House of London, England.

In use, the saxophone keys are fingered in the manner that is normal to the individual instrumentalist, to produce the desired acoustic tones; and the disclosed associated tone switches and tone circuits coact to produce electric tone signals that are adapted to activate the synthesizer—which thereupon produces a desired electronic sound. Most synthesizers have provisions for connecting an external keyboard and/or have provisions for accepting external signals; so that it is relatively easy to apply the above tone signals to the synthesizer.

Thus, the present invention causes the tone switches—mounted on the saxophone, and associated with respective saxophone keys—to function as a quasi-keyboard for the synthesizer, and to thus control the synthesizer output.

The Tone-Switch Arrangement

FIG. 2 shows a schematic wiring diagram illustrating typical electric interconnections. In this illustration, the saxophone keys are indicated by rectangles, and are identified by reference characters such as 17-2, 17-3, 17-4, etc.; and the saxophone keys 17 are also identified by having the rectangles enclose musical designations that identify the acoustic tone associated with that particular saxophone key. While the illustrated musical designations are for a saxophone, the disclosed principle also applies to other instruments.

Each saxophone key 17 has an associated tone switch identified by reference characters such as 18-1, 18-2, 18-3, 18-4, etc., their suffixes 2, 3, 4, etc., corresponding to their associated keys 17.

The tone switches 18 (except 18-1) are illustrated as being single pole, double-throw switches. The normally closed "passive" settings of the tone switches 18 are used to complete a "grounding" circuit that includes a common ground wire 19 electrically connected to the synthesizer; and the normally open "active" settings of the tone switches 18 are used in the production of tone signals—to be discussed later.

The Tone Signals

The saxophone has the characteristic that it is adapted to produce a middle-C-sharp-acoustic tone when it is not fingered. In order to provide a middle-C-sharp-electric-tone signal, tone switch 18-1 of FIG. 2 may be physically positioned next to the thumb hook of the saxophone, so that tone switch 18-1 may be conveniently operated by the tip of the right thumb. Tone switch 18-1 may be a single-pole, single-throw, normally-open, button-type microswitch, or its equivalent; and this is the only manually operated switch in the apparatus.

In use, when the instrumentalist desires to produce a middle-C-sharp acoustic tone, he blows into the saxophone—without fingering any of the keys; and he simultaneously manually sets tone switch 18-1 to its active setting. As may be seen from FIG. 2, there is now a completed electric grounding circuit from the common ground wire 19, through the passive settings of the tone switches 18-20 to 18-2, and through the active setting of the C-sharp tone switch 18-1; so that the tone circuit produces a C-sharp-tone signal, indicated by an encircled C sharp.

In this way, the instrumentalist can produce a C-sharp-acoustic tone and a simultaneous C-sharp-electric-tone signal that may be used to activate the synthesizer.

When the instrumentalist desires to produce a D-acoustic tone, he blows into the saxophone while using the basic fingering for the D key 17-2; and, in a manner to be discussed later, the fingering automatically sets the associated tone switch 18-2 to its active setting. As may be seen from FIG. 2, there is now a completed electric grounding circuit from the common ground wire 19, through the passive settings of the tone switches 18-20 to 18-3, and through the active setting of the D-tone switch 18-2; so that the tone circuit produces a D-tone signal, as indicated by the encircled D.

In this way, the instrumentalist can produce a D-acoustic tone and a simultaneous D-electric-tone signal that may be used to activate the synthesizer.

It should be noted (for reasons to be discussed later) that the C-sharp-tone switch 18-1, which is "above" the subject D-tone switch 18-2, has been disconnected from the grounding circuit by the active setting of the D-tone switch 18-2; so that these tone circuits are disabled.

When the instrumentalist desires to produce an E-flat-acoustic tone, he blows into the saxophone while using the basic fingering pattern for the E-flat key 17-3; and, the fingering automatically sets the associated tone switch 18-3 to its active setting. As may be seen from FIG. 2, there is now a completed electric grounding circuit from the common ground wire 19, through the passive setting of the tone switches 18-20 to 18-4, and through the active setting of the E-flat-tone switch 18-3; so that the tone circuit produces an E-flat-tone signal indicated by the encircled E flat.

In this way, the instrumentalist can produce an E-flat-acoustic tone and a simultaneous E-flat-electric-tone signal that may be used to activate the synthesizer.

It should be noted that, here too, the tone switches 18-1 and 18-2, which are "above" the subject E-flat-tone switch 18-3, have been disconnected from the grounding circuit by the active setting of the E-flat-tone switch 18-3; so that these tone circuits have been disabled.

When the instrumentalist desires to produce a low-B-flat-acoustic tone, he blows into the saxophone while using the basic fingering pattern for the B-flat key 17-20; and, the fingering automatically sets the associated tone switch 18-20 to its active setting. As may be seen from FIG. 2, there is now a completed electric grounding circuit from the common ground wire 19 through the active setting of the low-B-flat-tone switch 18-20; so that the tone circuit produces a low-B-flat-tone signal, indicated by the encircled B flat.

In this way, the instrumentalist can produce a low-B-flat-acoustic tone and a simultaneous low-B-flat-electric-tone signal that may be used to activate the synthesizer.

It should be noted, here too, that the tone switches 18-1 to 18-19, which are "above" the subject low-B-flat-tone switch 18-20, have been disconnected from the grounding circuit by the active setting of the B-flat-tone switch 18-20; so that these tone circuits are inoperative.

Thus, whenever a selected key 18 is fingered, it adapts the saxophone to produce its associated acoustic tone; and the associated tone switch automatically causes the tone circuit to produce a simultaneous corresponding tone signal. Moreover, the active setting of the selected-associated-tone switch also disables the ground circuit of all the tone switches that are "above" the selected-key-tone switch.

The reason for this disabling arrangement is as follows. The fingering pattern of a saxophone sometimes requires the fingering of additional keys, the additionally-fingered keys being used to modify the acoustic tone. However, in the disclosed invention, fingering these other keys would produce additional tone signals which may not be desirable. Therefore, an actuated tone switch disables all of the tone-signal-producing circuitry "above" it; and it retains the grounding circuit for all the tone switches below it.

For convenience, the tone switches "above" the selected-tone switch will be called the "supra"-tone switches; and the sequence shown at the left side of FIG. 2 serves to clarify the electrical relationship of the tone switches.

The saxophone has another characteristic—namely, certain keys have a dual function; that is, when fingered by themselves, they produce a given acoustic tone; whereas, when fingered simultaneously with another given key, the combination produces a different acoustic tone.

Referring again to FIG. 2, it will be seen that when the A/C-key 17-8 is fingered by itself the active setting of its associated-tone switch 18-8 produces a C-tone signal in the manner discussed above; while the saxophone produces a C-acoustic tone. However, when the A/C-key 17-8 is fingered simultaneously with the B key 17-6, a switch-ganging linkage indicated by the dotted line 21, causes a duality switch 22 to be set to its active setting; and the circuitry now produces an A-tone signal; while the saxophone produces an A-acoustic tone.

A second example of this dual-function-keying arrangement involves the E/F-sharp key 17-14 and the F key 17-12, a second linkage indicated at 23 being used to set a second duality switch 24.

In this way, the disclosed invention automatically produces tone signals corresponding to the acoustic tones produced by the dual-function keys of the saxophone.

In order to handle fast chromatic passages, the saxophone has alternative fingering patterns; and two of the most common of these—the side key indicated as the C-ALT. key 17-7, and the forked-F-sharp key indicated as the F-sharp-ALT. key 17-13—have been included into the circuitry.

The crossed wires of FIG. 2 are a drawing convenience for converting the musically non-chromatic, tone-switch arrangement at the left side of the drawing to the musically chromatic arrangement of the tone signals at the right side of the drawing.

The Octave Relay

The saxophone has another characteristic that certain keys can produce normal acoustic tones; and—by the use of an "octave relay"—can produce "duplicate" acoustic tones that are one octave higher in pitch.

Figure 3:
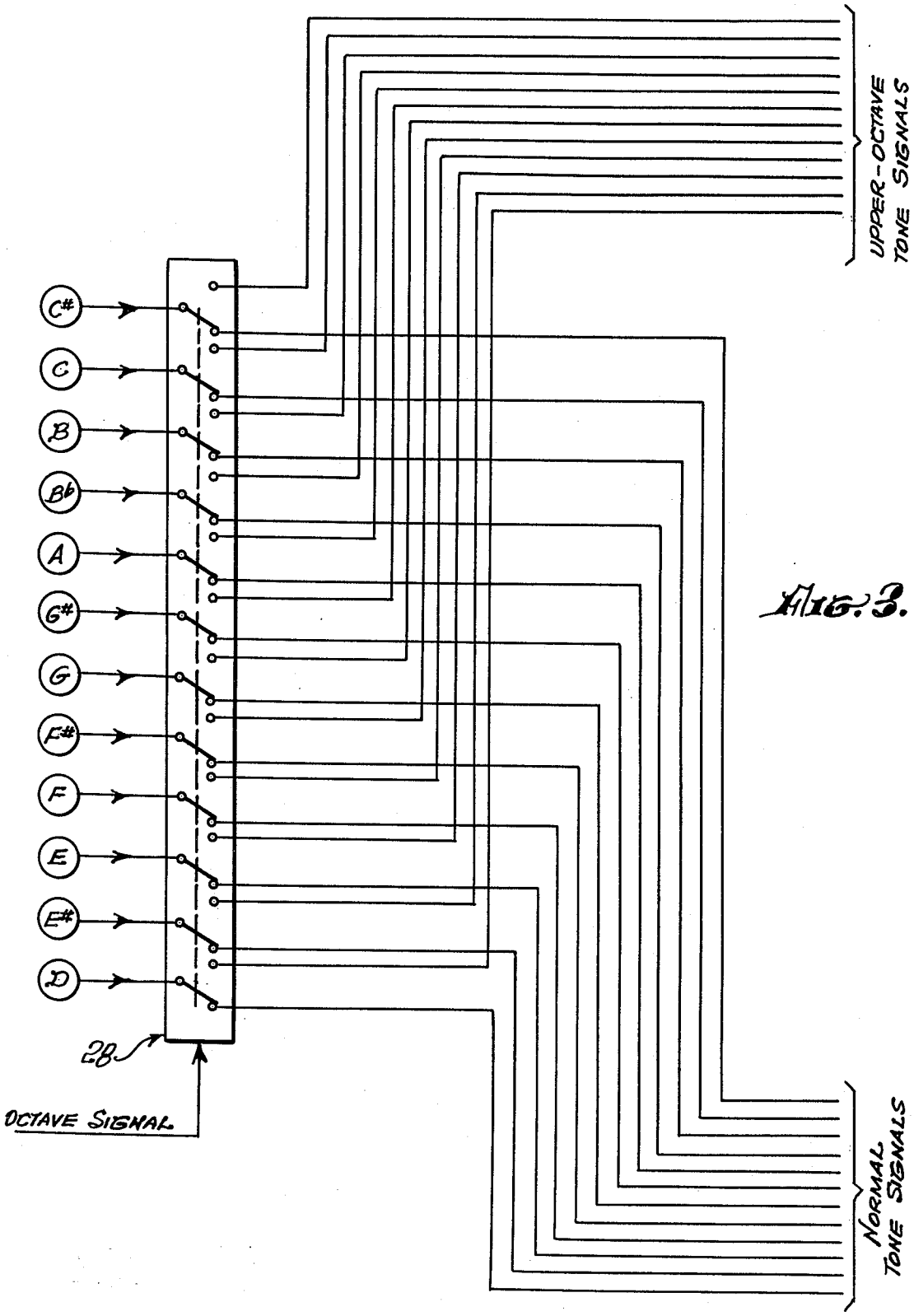
FIG. 3 shows a schematic wiring diagram of circuitry for producing upper-octave-tone signals.

In order to incorporate this characteristic into the subject invention, the saxophone's octave key 26-1 of FIG. 2 has an associated-octave switch 27-1 that is electrically connected to actuate an octave relay 28. When the octave key 26-1 is not fingered, its associated-octave switch 27-1 is in an open state as indicated; its octave circuit is not complete, no octave signal is produced, and the octave relay 28 is not actuated. Therefore, tone signals from tone switches 18-1 and 18-6 through 18-16 may traverse the passive setting (See FIG. 3.) of the octave relay 28, and emerge as "normal" tone signals that may be applied to the synthesizer.

On the other hand, when the octave key 26-1 is fingered, its associated-octave switch 27-1 is set to its active setting; the octave circuit is completed, an octave signal is produced, and the octave signal now actuates the octave relay 28. Therefore, tone signals from tone switches 18-1, and 18-6 through 18-16 may traverse the active setting of the octave relay 28, and emerge as upper-octave-tone signals that may be applied to the synthesizer to produce corresponding upper-octave-electronic sounds.

Since the tone signals from tone switches 18-1 and 18-6 through 18-16 may be replicated in a higher octave, the tone signals from these tone switches will be designated as "replicate" tone signals; and the output of the octave relay 28 will be designated as normal tone signals and upper-octave tone signals—depending upon the setting of the octave relay.

The octave relay, being physically quite small, may be mounted at any convenient location—one satisfactory mounting being attachment to the synthesizer.

The Staccato Effect

For certain musical compositions, it is desirable to have an acoustic-staccato effect—which is also known as a "re-attack and release"; and this effect may be achieved in a number of different ways—as, for example, by tonguing, by throat closure, by breath control, etc. The staccato effect is produced while the fingering pattern is maintained—which, in the present invention, would produce a continuous-non-staccato-tone signal for the synthesizer.

Most synthesizers can be programmed to produce a staccato effect; but this effect would then be produced continuously, which might be undesirable from a musical point of view. On the other hand, a staccato-tone signal might be produced by tapping the saxophone key in order to break up an otherwise-continuous-tone signal; but this might be undesirable from an acoustic point of view.

In order to achieve a staccato-tone signal, FIG. 2 shows the present invention to incorporate a normally closed "phone jack" 29 that is inserted into the common ground wire 19; and a foot-operated "pedal" switch 31 may be plugged into jack 29. In operation, a tapping movement of the foot causes the pedal switch 31 to rapidly open and close, this introducing an electric-staccato effect into the tone signal being produced at that particular time.

In this way, the pedal switch 31 produces an electric-staccato effect into the tone signal in correspondence with the acoustic-staccato effect produced by the saxophone.

An alternative way to obtain a staccato effect is shown in FIG. 1, this indicating a pressure-sensitive pickup 32, preferably positioned in the throat of saxophone 10; but it may alternatively be positioned in the bell portion of the saxophone. Pickup 32 senses pressure variations produced by the acoustic-staccato effect; and the pressure signal from pickup 32 may be applied (through an amplifier 33, if so desired) to a relay 34 that may be plugged into the phone jack 29.

In this way, the acoustic-staccato effect is converted by the pickup 32 into a staccato signal, the amplifier 33 serving to amplify and control the sensitivity, and the relay 34 functioning to control the on/off intervals of the synthesizer.

It has been found that the pressure-sensitive pickup 32 may be a microphone that is equally responsive to all frequencies, being thus pressure-sensitive, rather than frequency-sensitive.

The Tone-Switch Arrangement

FIG. 4 shows a view of a typical tone-switch arrangement for a saxophone. Here, the tone hole 36 comprises a hole collar 37; and a pad cup 38 has an internal pad 39 that is adapted to seat itself onto the hole collar 37—to thus open or to seal the tone hole 36.

When the instrumentalist fingers the proper key (not shown), the mechanically complex keywork pivots the key arm 41 to raise or lower the pad cup 38 as indicated by the double-ended arrow.

In FIG. 4, the illustrated tone-switch assembly comprises a magnetic-reed switch 42—such as model E2-100 manufactured by GC Electronics of Rockford, Ill.—such magnetic-reed switches being available in a wide variety of sizes from a number of different manufacturers. These magnetic-reed switches, in general, comprise a small sealed glass tube that contains two or more longitudinally positioned reeds—at least one of them, the switching reed, being adapted to flex under the influence of a magnetic field. The magnetic-reed switch may be of the single-pole, single-throw type; of the single-pole, double-throw type; etc.—depending upon the design and the number of reeds. A suitable number of electric lead wires are incorporated into the magnetic-reed switch. In the present case, it has been advisable to use single-pole, double-throw, magnetic-reed switches—for the reasons previously mentioned; so that the normally closed setting of the magnetic-reed switch becomes the passive setting, and the normally open setting becomes the active setting.

FIG. 4 indicates that the magnetic-reed, tone switch 42 is mounted to the body of the saxophone 10; and FIG. 4 further indicates that a small permanent magnet 43 is mounted to the pad cup 38—although the magnetic-reed switch and the permanent magnet may alternatively be mounted at other coacting locations, or at suitable locations of the keywork.

The illustrated magnetic-reed, tone-switch-and-magnet assembly has several advantages—it is extremely lightweight, it is quite small, it is very reliable, it has practically no effect on normal saxophone usage, each component is readily mounted at its desired location, suitable adhesives provide a substantially permanent installation, etc.

In operation, the fingering action moves the pad cup 38, as discussed above; and the magnet 43, therefore, moves, as indicated by the double-ended arrow, into closer or more-remote relation to the magnetic-reed switch 42—which thereupon responds by flexation of its switching reed and thus interrupting or completing its associated tone circuit.

Each of the other saxophone keys has a similar tone-switch arrangement; so that, as the various keys provide acoustic tones, their associated tone switches automatically provide corresponding tone signals.

As is known to those skilled in the art, some of the saxophone tone holes are normally open (as illustrated and discussed in connection with FIG. 4), and are closed by the fingering pattern and the keyworks; whereas other tone holes are normally closed (not illustrated), and are opened by the fingering pattern and the keyworks.

In these latter cases, the plurality of a tone switch and its associated permanent magnet cause the switching reed of the magnetic-reed switch to flex; so that the normally open setting of the magnetic-reed switch is now closed—thus becoming the passive setting of the magnetic-reed switch; whereas the normally closed setting of the magnetic-reed switch is now open—becoming the active setting of the tone switch.

This reversed operation of the magnetic-reed switch has proved to be completely satisfactory, and has not caused any problems.

While the above-described, magnetic-reed-switch assemblies have proved eminently satisfactory, the tone-switching arrangement may alternatively use other or newly developed switches—such as microswitches, capacitive switches, pressure switches, logic switches, or the like.

These magnetic-reed switches have the desirable characteristic that they interrupt and complete the tone circuits without introducing any objectionable electric transient signals that show up as popping sounds; but it may be necessary under some conditions to utilize electric networks to minimize such transients.

In this way, a quasi-keyboard for a synthesizer is provided; the quasi-keyboard is not fingered in the usual manner, but is operated by the playing patterns of the musical instrument.

The Switch-Ganging Linkage

It was pointed out in connection with the duality switches 22 and 24 of FIG. 2 that switch-ganging linkages 21 and 23 were required. These linkages may take a number of forms—depending upon the switches, their spatial relation to each other, etc.

The use of magnetic-reed switches and permanent magnets permits the use of an unusual linkage, as illustrated in FIG. 4. Here, a duality-switch assembly comprises a magnetic-reed switch 44 and a permanent magnet 46. It will be realized that, when the pad cup 38 moves downward, the tone-switch assembly 42 and 43, and the duality-switch assembly 44 and 46, are both simultaneously set to their active settings; in this case, the linkage is the mechanical structure of the tone-hole-and-pad-cup assembly.

Alternatively, the duality-switch assembly may be mounted on convenient portions of the keyworks, or at other suitable locations.

Tonal Effects

The present invention discloses a quasi-keyboard that permits a musical instrument to activate an electronic device to produce electric waveforms that may then be converted to electronic sounds. While a number of different musical instruments and electronic devices may be used, the specific exemplification has been presented in terms of an acoustic saxophone and a musical synthesizer; and the exemplified combination can provide a wide variety of tonal effects that an instrumentalist was previously unable to produce.

As a first example, the saxophone may be played alone; and the electronic sounds introduced whenever desired—as by the use of the described pedal switch.

As a second example, the synthesizer may be used as an accompaniment, being programmed for desired tonal effects.

As a third example, the combination may be used to play "double stops"—a characteristic not feasible for the saxophone alone. To do this, the saxophone is played acoustically in one acoustic range; and the fingering of a selected key—that does not affect the acoustic sound—produces a simultaneous electronic sound.

As a fourth example, the quasi-keyboard may be used to produce electronic sounds while the saxophone remains unblown.

As another example, the saxophone and the synthesizer may be played alternately.

As still another example, the combination can produce continuous acoustic tones and staccato electronic sounds, or can produce continuous electronic sounds and staccato acoustic tones.

As still another example, the synthesizer may be programmed to produce "parallel tracking", wherein it produces electronic sounds that retain a predetermined musical interval above or below the acoustic tone produced by the saxophone.

As still another example, the synthesizer may be programmed for a variety of electronic effects—percussion, decay, sustention, echo, tremolo, balance, etc.

As still another example, the synthesizer may be made to produce staccato effects whenever desired.

Most synthesizers have the capability of transposing the tonal output either up or down in pitch, the control being known as the transposing knob. The use of this knob permits the synthesizer to be adapted to different types of saxophones, to control the musical intervals of the parallel-tracking capability discussed earlier, etc.

The above-foregoing explanation has been presented in terms of a monophonic synthesizer—that is, a synthesizer adapted to accept a single input signal, and to produce a single output. However, a polyphonic synthesizer may also be used. In such a case, the tone signals may be split, and applied to the polyphonic synthesizer in such a way that the synthesizer can use the split signals. Such an arrangement may, for example, produce an accompanying sound and a contrasting chord.

In the foregoing presentation, the synthesizer has been of the type wherein a predetermined voltage is directed to suitable circuits of the synthesizer; and the disclosed quasi-keyboard functions as a set of switches that achieves this result.

However, some synthesizers are of the type wherein different voltages are provided for the circuits of the synthesizer. The disclosed quasi-keyboard may—instead of completing a tone circuit, as discussed—tap off suitable different voltages from a voltage divider. These different voltages may then be applied to the circuits of the synthesizer, the different voltages thus functioning as tone signals.

There are quite a number of electronic devices that produce various types of electric waveforms, the exemplified musical synthesizer being only one of these—others being the Novachord, the Theramin, various waveform generators, etc. The publication "Harper's Dictionary of Music", published by Harper and Row, and authored by Christine Ammer defines the term "electrophone"as " any musical instrument that produces sound by electric or electronic means"; and this term will be used as being generic to the musical synthesizer and other electronic devices of that general type.

Other Instruments

It was pointed out above that the disclosed invention is adaptable to musical instruments having a substatially one-to-one relationship between the emitted acoustic tone and the positions of the tone-control elements, this being the case in a saxophone wherein the tone-control elements are the saxophone keys.

Other musical instruments have similar one-to-one relationships, these instruments including flutes, trombones, basoons, piano, and some woodwind and brass instruments—although, in some cases, these instruments depart from the one-to-one relationship because of the instrumentalist's playing techniques.

The trombone has an essentially one-to-one relationship between the position of its tone-control-slide element and the emitted tone. In this case, a tongue or tab on the slide element may be adapted to set selected tone switches that produce tone signals corresponding to the acoustic tones—in accordance with the above teachings.

Alternatively, as illustrated in FIG. 5, the trombone 44 may comprise a resistor 46 such as a rotatable potentiometer or rheostat whose angular orientation is controlled by a cable 47 attached to the slide element 48. Thus, as the slide element 48 moves, the potentiometer assumes corresponding angular orientations, a spring urging the potentiometer back to its quiescent orientation.

In this way, different voltages—corresponding to the position of the slide element—are produced; and these function as tone signals to activate the synthesizer.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A musical instrument adapted to produce acoustic tones;

playing means, mounted on said musical instrument, for causing said musical instrument to produce selected acoustic tones;

an electrophone operably attached to said musical instrument;

a quasi-keyboard for said electrophone—said quasi-keyboard being mounted on said musical instrument, and being adapted to cause the electrophone to produce electronic sounds regardless of whether or not said musical instrument is producing acoustic tones;

means, interconnecting said electrophone and said quasi-keyboard, for causing said electrophone to produce electronic sounds that are concomitant with selected acoustic tones;

said musical instrument is a trombone having a slide tone-control element;

tone-signal-producing means comprising a variable resistor;

means for associating said variable resistor with said slide tone-control element of said trombone musical instrument;

said variable resistor being thus sensitive to the instantaneous position of said slide tone-control element of said trombone, and thus producing an instantaneous resistive value and a tone signal associated with the instantaneous position of said slide tone-control element.

2. A musical instrument adapted to produce acoustic tones;

playing means, mounted on said musical instrument, for causing said musical instrument to produce selected acoustic tones;

an electrophone operably attached to said musical instrument;

a quasi-keyboard for said electrophone—said quasi-keyboard being mounted on said musical instrument, and being adapted to cause the electrophone to produce electronic sounds regardless of whether or not said musical instrument is producing acoustic tones;

means, interconnecting said electrophone and said quasi-keyboard, for causing said electrophone to produce electronic sounds that are concomitant with selected acoustic tones;

said musical instrument comprising an integral octave key adapted to produce acoustic tones one octave above the normal acoustic tones of said musical instrument;

means comprising an octave-key tone switch associated with said octave key, for automatically causing said electrophone to produce electronic sounds that are concomitant with said octave acoustic sounds.

* * * * *